United States Patent [19]

Irwin

[11] Patent Number: 4,737,125

[45] Date of Patent: Apr. 12, 1988

[54] MARINE PROPULSION DEVICE THROTTLE CONTROL

[75] Inventor: Gregory D. Irwin, Lindenhurst, Ill.

[73] Assignee: Outboard Marine Corporation, Waukegan, Ill.

[21] Appl. No.: 861,445

[22] Filed: May 9, 1986

[51] Int. Cl.[4] ..... B63H 5/12

[52] U.S. Cl. ..... 440/87; 440/77

[58] Field of Search ..... 440/77, 84, 87; 123/342, 343, 195 P, 413; 74/502, 527

[56] References Cited

U.S. PATENT DOCUMENTS

| | | | |
|---|---|---|---|
| 2,676,559 | 4/1954 | Davies | 440/77 X |
| 2,858,819 | 11/1958 | Pollari | 440/87 X |
| 2,944,508 | 7/1960 | Kiekhaefer | 440/87 X |
| 3,135,234 | 6/1964 | Turnidge | 440/87 X |
| 3,393,578 | 7/1968 | Tschanz | 74/501 |
| 3,479,903 | 11/1969 | Hermanson et al. | 74/502 |
| 3,732,748 | 5/1973 | Cavalli | 74/502 |
| 4,227,428 | 10/1980 | Zifferer et al. | 74/526 |
| 4,337,053 | 6/1982 | Stevens | 440/87 |
| 4,432,390 | 2/1984 | Brazil | 137/625.46 |
| 4,548,094 | 10/1985 | Huitema et al. | 74/526 |
| 4,611,502 | 9/1986 | Gregory | 74/502 |

*Primary Examiner*—Sherman D. Basinger

*Attorney, Agent, or Firm*—Michael, Best & Friedrich

[57] ABSTRACT

A marine propulsion device comprising a mounting assembly adapted to be mounted on the transom of a boat, a propulsion unit mounted on the mounting assembly for pivotal movement relative thereto about a generally vertical steering axis, the propulsion unit including a rotatably mounted propeller, and an internal combustion engine drivingly connected to the propeller and including a throttle, a throttle control member movably mounted on the propulsion unit for controlling the throttle, a stop member mounted on the propulsion unit for movement relative thereto, the stop member having a surface located adjacent the throttle control member for limiting movement of the throttle control member, and a thumb wheel for moving the stop member, thereby adjusting the limit of movement of the throttle control member.

10 Claims, 1 Drawing Sheet

MARINE PROPULSION DEVICE THROTTLE CONTROL

BACKGROUND OF THE INVENTION

The invention relates to throttle controls for marine propulsion devices, and, more particularly, to throttle controls for small outboard motors.

On small outboard motors, i.e. outboard motors without a reversible transmission, it is often desirable to have the engine idle above its lowest possible idle speed for such operation as back trolling. For ease of operation, some outboard motors have a stop mechanism which limits movement of the throttle control to limit idle speed and which can be adjusted by the operator in order to set the idle speed. Known stop mechanisms are adjusted with a tool such as a screwdriver. This can be inconvenient if the operator does not have such a tool at hand.

Attention is directed to the following U.S. Pats.:
Huitema, U.S. Pat. No. 4,548,094, Oct. 22, 1985.
Brazil, U.S. Pat. No. 4,432,390, Feb. 21, 1984.
Zifferer, U.S. Pat. No. 4,227,428, Oct. 14, 1980.
Tschanz, U.S. Pat. No. 3,393,578, July 23, 1968.

SUMMARY OF THE INVENTION

The invention provides a marine propulsion device comprising a mounting assembly adapted to be mounted on the transom of a boat, a propulsion unit mounted on the mounting assembly for pivotal movement relative thereto about a generally vertical steering axis, the propulsion unit including a rotatably mounted propeller, and an internal combustion engine drivingly connected to the propeller and including a throttle, a cowl assembly surrounding the engine and including a generally horizontal top portion located above the engine, a throttle control member movably mounted on the top portion of the cowl assembly for controlling the throttle, a stop member mounted on the top portion of the cowl assembly for movement relative thereto, the stop member having a surface located adjacent the throttle control member for limiting movement of the throttle control member, a manually actuatable adjustment member mounted on the top portion of the cowl assembly for movement relative thereto, and means for moving the stop member in response to movement of the adjustment member, thereby adjusting the limit of movement of the throttle control member.

In one embodiment, the adjustment member is mounted on the propulsion unit for rotation relative thereto, and the means for moving the stop member includes means for moving the stop member in response to rotation of the adjustment member.

In one embodiment, the stop member has a longitudinal axis and an end including the surface, the stop member is mounted on the propulsion unit for movement relative thereto along the longitudinal axis, and the means for moving the stop member includes means for moving the stop member along the longitudinal axis in response to rotation of the adjustment member.

In one embodiment, the throttle control member, the stop member, and the adjustment member are mounted on the top portion of the cowl assembly.

The invention also provides a marine propulsion device comprising a mounting assembly adapted to be mounted on the transom of a boat, a propulsion unit mounted on the mounting assembly for pivotal movement relative thereto about a generally vertical steering axis, the propulsion unit including a rotatably mounted propeller, and an internal combustion engine drivingly connected to the propeller and including a throttle, a cowl assembly surrounding the engine and including a generally horizontal top portion located above the engine, a throttle control member movably mounted on the top portion of the cowl assembly for controlling the throttle, a stop member having a longitudinal axis and being mounted on the top portion of the cowl assembly for movement relative thereto along the longitudinal axis, the stop member having an end located adjacent the throttle control member for limiting movement of the throttle control member, a thumb wheel mounted on the top portion of the cowl assembly for rotation relative thereto, and means for moving the stop member along the longitudinal axis in response to rotation of the thumb wheel, whereby rotation of the thumb wheel adjusts the position of the end of the stop member, thereby adjusting the limit of movement of the throttle control member.

In one embodiment, the stop member is externally threaded, the thumb wheel includes an internally threaded passage centered on the longitudinal axis and threadedly receiving the stop member, and the means for moving the stop member along the longitudinal axis includes means for preventing rotation of the stop member about the longitudinal axis while affording movement of the stop member along the longitudinal axis, and means for preventing movement of the thumb wheel along the longitudinal axis while affording rotation of the thumb wheel about the longitudinal axis.

In one embodiment, the propulsion unit also includes a cowl assembly surrounding the engine and including a generally horizontal top portion, and the throttle control member, the stop member, and the thumb wheel are mounted on the top portion of the cowl assembly.

The invention also provides a marine propulsion device comprising a mounting assembly adapted to be mounted on the transom of a boat and a propulsion unit mounted on the mounting assembly for pivotal movement relative thereto about a generally vertical steering axis, which propulsion unit includes a rotatably mounted propeller, an engine drivingly connected to the propeller and including a throttle, a cowl assembly surrounding the engine and including a generally horizontal top portion located above the engine, a throttle control member movably mounted on the top portion of the cowl assembly for controlling the throttle, a thumb wheel on the top portion of the cowl assembly and including an internally threaded passage, an externally threaded stop member having a longitudinal axis and extending through the passage in threaded engagement with the thumb wheel, which stop member includes an end located adjacent the throttle control member for limiting movement of the throttle control member, means on the top portion of the cowl assembly for preventing rotation of the stop member about the horizontal axis while affording movement of the stop member along the horizontal axis, and means on the top portion of the cowl assembly for preventing movement of the thumb wheel along the longitudinal axis while affording rotation of the thumb wheel about the longitudinal axis, whereby rotation of the thumb wheel about the longitudinal axis causes movement of the stop member along the longitudinal axis, thereby moving the end of the stop member and adjusting the limit of movement of the throttle control member.

The invention also provides a marine propulsion device comprising a mounting assembly adapted to be mounted on the transom of a boat, and a propulsion unit mounted on the mounting assembly for pivotal movement relative thereto about a generally vertical axis, which propulsion unit includes a rotatably mounted propeller, an internal combustion engine drivingly connected to the propeller and including a throttle movable relative to an idle position, a cowl assembly surrounding the engine and including a top portion located above the engine, and means on the top portion of the cowl assembly for controlling the throttle, which controlling means includes means for adjustably locating the throttle idle position.

A principal feature of the invention is the provision of a marine propulsion device comprising a throttle control member, a stop member for limiting movement of the throttle control member. and a manually actuatable adjustment member for moving the stop member. This arrangement permits the operator to adjust the idle speed of the engine without tools.

Other principal features and advantages of the invention will become apparent to those skilled in the art upon review of the following detailed description, claims, and drawings.

DESCRIPTION OF THE DRAWINGS

In FIG. 1, the marine propulsion device faces right.

In FIG. 2, the marine propulsion device faces left (the reverse of FIG. 1).

In FIG. 3, the marine propulsion device faces left.

Figure 1:
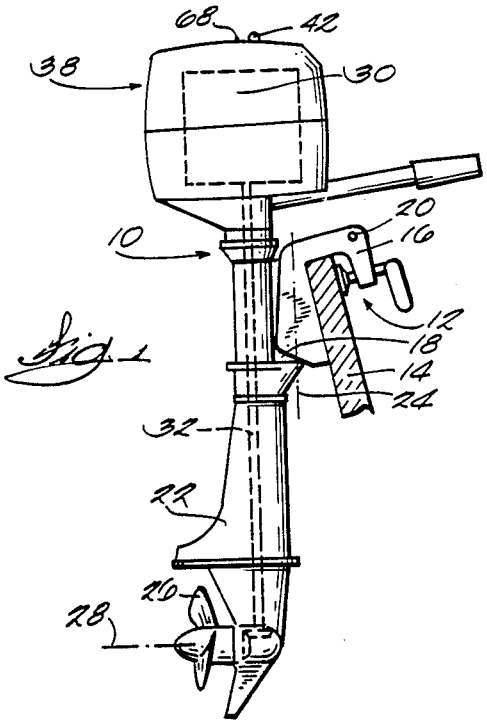
FIG. 1 is a side elevational view of a marine propulsion device which embodies various of the features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 which embodies various of the features of the invention is illustrated in the drawings. As best shown in FIG. 1, the marine propulsion device 10 is preferably a conventional outboard motor comprising a mounting assembly 12 adapted to be mounted on the transom 14 of a boat. While various suitable mounting assemblies can be employed, in the preferred embodiment, the mounting assembly 12 includes a transom bracket 16 fixedly mounted on the transom 14, and a swivel bracket 18 mounted on the transom bracket 16 for pivotal movement relative thereto about a generally horizontal tilt axis 20.

The marine propulsion device 10 also comprises a propulsion unit 22 mounted on the swivel bracket 18 for pivotal movement relative thereto about a generally vertical steering axis 24, and for common movement with the swivel bracket 18 about the tilt axis 20. The propulsion unit 22 has front and rear ends (right and left ends respectively in FIG. 1 and left and right ends respectively in FIG. 2) and includes a rotatably mounted propeller 26 having a rotary axis 28 and propelling the boat in one direction along the rotary axis 28, i.e., in the direction from the rear end of the propulsion unit 22 toward the front end of the propulsion unit. In the preferred embodiment, the propulsion unit 22 is rotatable through 360° about the steering axis 24 so that the boat can be propelled in any direction simply by rotating the propulsion unit 22. More specifically, in the preferred embodiment, the propulsion unit 22 is rotatable about the steering axis 24 between a forward-drive position wherein the propeller 26 propels the boat forwardly, and a rearward-drive position spaced approximately 180° from the forward-drive position wherein the propeller 26 propels the boat rearwardly.

The propulsion unit 22 also includes an engine 30 drivingly connected to the propeller 26 by a conventional drive train 32. The engine 30 includes (see FIG. 3) a throttle 31 (shown schematically in FIG. 3), a flywheel 34, and a timing plate 36 mounted beneath the flywheel 34 for controlling the spark timing of the engine 30. The timing plate 36 is connected to the throttle by a conventional linkage 37 (shown schematically in FIG. 3) for opening and closing the throttle in response to rotation of the timing plate 36. Such an arrangement is disclosed in Soder U.S. Pat. No. 2,906,251, issued Sept. 29, 1959, which is incorporated herein by reference. The propulsion unit 22 also includes a cowl assembly 38 surrounding the engine and including a generally horizontal top portion 40.

The marine propulsion device 10 also comprises a throttle control member or knob 42 for controlling, i.e. opening and closing, the throttle. In the illustrated construction, the throttle control member 42 is mounted on the top portion 40 of the cowl assembly 38 for generally linear, horizontal movement relative thereto, and the throttle control member 42 is movable in the direction of or parallel to the rotary axis 28 of the propeller 26. More particularly, the throttle control member 42 is movable in the direction from the rear of the propulsion unit 22 to the front of the propulsion unit 22 (the direction in which the propeller 26 propels the boat) for opening the throttle, and is movable in the direction from the front of the propulsion unit 22 to the rear of the propulsion unit 22 for closing the throttle. Still more particularly, the throttle control member 42 is movable in a generally vertical plane including the rotary axis 28. In other words, the throttle control member 42 is located directly above the rotary axis 28.

Figure 4:
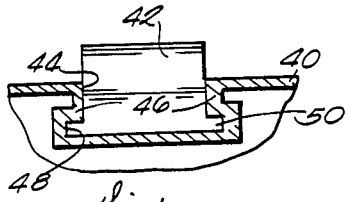
FIG. 4 is a cross-sectional view taken along line 4—4 in FIG. 2.
Figure 2:
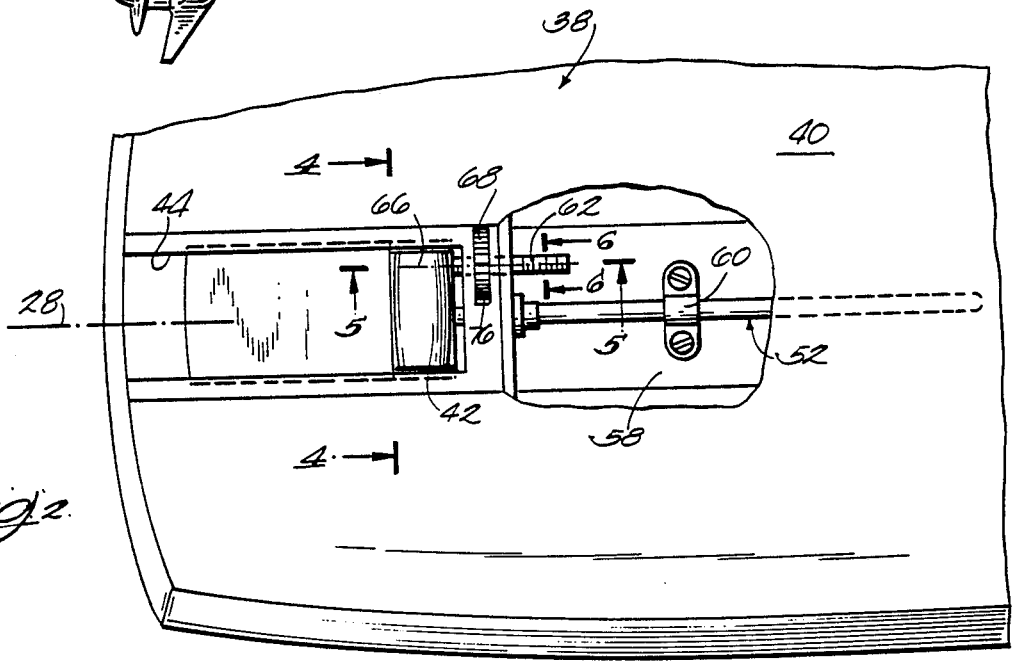
FIG. 2 is an enlarged, partial top view of the marine propulsion device.
Figure 3:
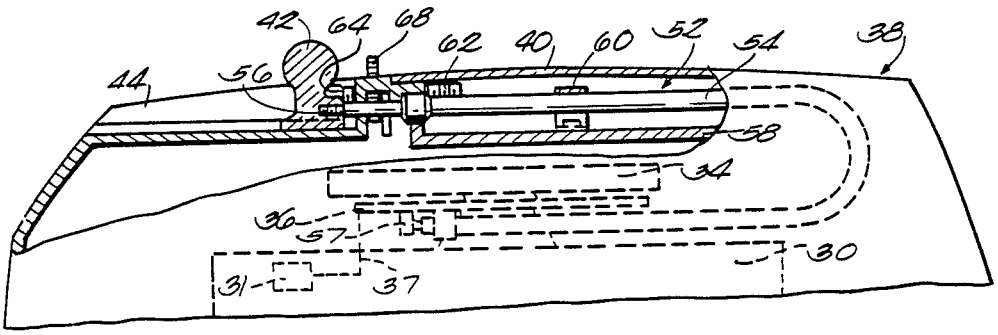
FIG. 3 is an enlarged side elevational view, partially in cross-section, of the upper portion of the marine propulsion device.

The marine propulsion device 10 also comprises means for retaining the throttle control member 42 on the top portion 40 of the cowl assembly 38, and for guiding movement of the throttle control member 42. While various suitable retaining and guiding means can be used, in the illustrated construction, as shown in FIGS. 2–4, such means includes, in the top portion 40 of the cowl assembly 38, an elongated recess 44 extending in the direction of the rotary axis 28. The throttle control member or knob 42 is slidably mounted in the recess 44, and the recess 44 has opposed side walls 46 which guide movement of the knob 42. As best shown in FIG. 4, the recess walls 46 include cut-out portions 48, and the knob 42 includes flange portions 50 slidably received in the cut-out portions 48 for retaining the knob 42 in the recess 44.

The knob 42 is operatively connected to the timing plate 36 by a conventional push-pull cable 52 (see FIGS. 2 and 3) so that movement of the knob 42 causes rotation of the timing plate 36. The cable 52 includes an outer sheath 54, and an inner core 56 slidably extending through the sheath 54. The outer sheath 54 is anchored relative to the cowl assembly 38 so that movement of the knob 42 causes movement of the core 56 within the sheath 54. In the preferred embodiment, the engine 30 includes a conventional starter housing 58 (shown only partially in FIG. 3) mounted above the flywheel 34, and the outer sheath 54 is anchored to the starter housing 58 by a conventional clamp 60 (FIGS. 2 and 3). One end of the core 56 is fixedly connected to the knob 42, and the other end of the core 56 is fixedly connected to the timing plate 36. In the preferred embodiment, the one end of the core 56 is threaded into the knob 42, and the other end of the core 56 is connected to the timing plate 36 by a linkage 57 (FIG. 3). A suitable linkage is described in U.S. Clark et al. patent application Ser. No. 851,954, filed Apr. 14, 1986 and assigned to the assignee of the present invention, now U.S. Pat. No. 4,703,731 the cable core 56 is connected to the timing plate 36 such that movement of the knob 42 toward the front of the propulsion unit 22 opens the throttle, and movement of the knob 42 toward the rear of the populsion unit 22 closes the throttle.

Figure 5:
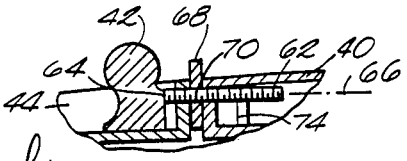
FIG. 5 is a cross-sectional view taken along line 5—5 in FIG. 2.

The marine propulsion device 10 also comprises (see FIGS. 2, 3 and 5) a stop member 62 mounted on the propulsion unit 22 for movement relative thereto. The stop member 62 has a surface 64 (FIGS. 3 and 5) located adjacent the throttle control member 42 for limiting movement of the throttle control member 42. In the preferred embodiment, the stop member 62 is an elongated member having a longitudinal axis 66 generally parallel to the rotary axis 28 of the propeller 26, and the stop member 62 is mounted on the top portion 40 of the cowl assembly 38 and has a forward end including the above-mentioned surface 64 for limiting movement of the throttle control member 42. As best shown in FIG. 2, the stop member 62 is mounted rearwardly of the throttle control member 42 so that the forward end of the stop member 62 determines the limit of movement of the throttle control member 42 in the direction closing the throttle, thereby determining the idle speed of the engine 30.

The marine propulsion device 10 also comprises a manually actuatable adjustment member or thumb wheel 68 mounted on the propulsion unit 22 for movement relative thereto. In the preferred embodiment, the thumb wheel 68 is mounted on the top portion 40 of the cowl assembly 38 for rotation relative thereto.

The marine propulsion device 10 further comprises means for moving the stop member 62 in response to movement of the thumb wheel 68, thereby adjusting the limit of movement of the throttle control member 42. In the preferred embodiment, this moving means moves the stop member 62 along its longitudinal axis 66 in response to rotation of the thumb wheel 68.

In the preferred embodiment, the stop member 62 is externally threaded, and the thumb wheel 68 includes (see FIG. 5) an internally threaded passage 70 centered on the longitudinal axis 66 of the stop member 62 and threadedly receiving the stop member 62. In other words, the stop member 62 extends through the passage 70 in threaded engagement with the thumb wheel 68. Additionally, the means for moving the stop member 62 includes means for preventing rotation of the stop member 62 about the longitudinal axis 66 while affording movement of the stop member 62 along the longitudinal axis 66, and means for preventing movement of the thumb wheel 68 along the longitudinal axis 66 while affording rotation of the thumb wheel 68 about the longitudinal axis 66.

Figure 6:
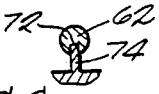
FIG. 6 is a cross-sectional view taken along line 6—6 in FIG. 2.

While various suitable means can be used for preventing rotation of the stop member 62, in the illustrated construction, such means includes slot and a key means on the stop member 62 and on the propulsion unit 22. More particularly, as shown in FIG. 6, the slot and key means includes, in the stop member 62, a slot 72 extending parallel to the longitudinal axis 66, and, on the propulsion unit 22, a finger or key 74 slidably received in the slot 72 for preventing rotation of the stop member 62 about the longitudinal axis 66 while affording movement of the stop member 62 along the longitudinal axis 66. The key 74 can be either an integral part of the cowl assembly 38 or a part of the starter housing 58.

While various suitable means can be employed for preventing movement of the thumb wheel 68, in the preferred embodiment, such means includes wall means on the top portion of the cowl assembly 38. More particularly, as best shown in FIG. 2, the cowl assembly 38 includes wall means defining a slot 76 which extends generally perpendicular to the longitudinal axis 66 and through which the thumb wheel 68 extends. The slot 76 permits rotation of the thumb wheel 68 about the longitudinal axis 66 but prevents movement of the thumb wheel 68 along the longitudinal axis 66.

The idle speed adjustment arrangement operates as follows: Because the thumb wheel 68 is prevented from moving along the longitudinal axis 66 and because the stop member 62 is prevented from rotating about the longitudinal axis 66, rotation of the thumb wheel 68 in one direction causes movement of the stop member 62 toward the knob 42, thereby increasing the idle speed of the engine 30. Rotation of the thumb wheel 68 in the other direction causes movement of the stop member 62 away from the knob 42, thereby decreasing the idle speed of the engine 30.

Various features and advantages of the invention are set forth in the following claims.

I claim:

1. A marine propulsion device comprising a mounting assembly adapted to be mounted on the transom of a boat, and a propulsion unit mounted on said mounting assembly for pivotal movement relative thereto about a generally vertical steering axis, said propulsion unit including a rotatably mounted propeller, an internal combustion engine drivingly connected to said propeller and including a throttle, a cowl assembly surrounding said engine and including a generally horizontal top portion located above said engine, a throttle control member movably mounted on said top portion of said cowl assembly for controlling said throttle, a stop member mounted on said top portion of said cowl assembly for movement relative thereto, said stop member having a surface located adjacent said throttle control member for limiting movement of said throttle control member, a manually actuatable adjustment member mounted on said top portion of said cowl assembly for movement relative thereto, and means for moving said stop member in response to movement of said adjustment member, thereby adjusting the limit of movement of said throttle control member.

2. A marine propulsion device as set forth in claim 1 wherein said adjustment member is mounted for rotation relative to said cowl assembly, and wherein said means for moving said stop member includes means for moving said stop member in response to rotation of said adjustment member.

3. A marine propulsion device as set forth in claim 2 wherein said stop member has a longitudinal axis and an end including said surface, wherein said stop member is mounted for movement relative to said cowl assembly along said longitudinal axis, and wherein said means for moving said stop member includes means for moving said stop member along said longitudinal axis in response to rotation of said adjustment member.

4. A marine propulsion device comprising a mounting assembly adapted to be mounted on the transom of a boat, and a propulsion unit mounted on said mounting assembly for pivotal movement relative thereto about a generally vertical steering axis, said propulsion unit including a rotatably mounted propeller, an internal combustion engine drivingly connected to said propeller and including a throttle, a cowl assembly surrounding said engine and including a generally horizontal top portion located above said engine, a throttle control member movably mounted on said top portion of said cowl assembly for controlling said throttle, a stop member having a longitudinal axis and being mounted on said top portion of said cowl assembly for movement relative thereto along said longitudinal axis, said stop member having an end located adjacent said throttle control member for limiting movement of said throttle control member, a thumb wheel mounted on said top portion of said cowl assembly for rotation relative thereto, and means for moving said stop member along said longitudinal axis in response to rotation of said thumb wheel, whereby rotation of said thumb wheel adjusts the position of said end of said stop member, thereby adjusting the limit of movement of said throttle control member.

5. A marine propulsion device as set forth in claim 4 wherein said stop member is externally threaded, wherein said thumb wheel includes an internally threaded passage centered on said longitudinal axis and threadedly receiving said stop member, and wherein said means for moving said stop member along said longitudinal axis includes means for preventing rotation of said stop member about said longitudinal axis while affording movement of said stop member along said longitudinal axis, and means for preventing movement of said thumb wheel along said longitudinal axis while affording rotation of said thumb wheel about said longitudinal axis.

6. A marine propulsion device comprising a mounting assembly adapted to be mounted on the transom of a boat, and a propulsion unit mounted on said mounting assembly for pivotal movement relative thereto about a generally vertical steering axis, said propulsion unit including a rotatably mounted propeller, an engine drivingly connected to said propeller and including a throttle, a cowl assembly surrounding said engine and including a generally horizontal top portion located above said engine, a throttle control member movably mounted on said top portion of said cowl assembly for controlling said throttle, a thumb wheel on said top portion of said cowl assembly and including an internally threaded passage, an externally threaded stop member having a longitudinal axis and extending through said passage in threaded engagement with said thumb wheel, said stop member including an end located adjacent said throttle control member for limiting movement of said throttle control member, means on said top portion of said cowl assembly for preventing rotation of said stop member about said longitudinal axis while affording movement of said stop member along said longitudinal axis, and means on said top portion of said cowl assembly for preventing movement of said thumb wheel along said longitudinal axis while affording rotation of said thumb wheel about said longitudinal axis, whereby rotation of said thumb wheel about said longitudinal axis causes movement of said stop member along said longitudinal axis, thereby moving said end of said stop member and adjusting the limit of movement of said throttle control member.

7. A marine propulsion device comprising a mounting assembly adapted to be mounted on the transom of a boat, and a propulsion unit mounted on said mounting assembly for pivotal movement relative thereto about a generally vertical steering axis, said propulsion unit including a rotatably mounted propeller, an internal combustion engine drivingly connected to said propeller and including a throttle movable relative to an idle position, a cowl assembly surrounding said engine and including a top portion located above said engine, and means on said top portion of said cowl assembly for controlling said throttle, said controlling means including means for adjustably locating said throttle idle position.

8. A marine propulsion device as set forth in claim 2 wherein said means for controlling said throttle comprises a throttle control member movably mounted on said cowl assembly for controlling said throttle, and wherein means for adjustably locating said throttle idle position comprises a stop member mounted on said cowl assembly for movement relative thereto and having a surface located adjacent said throttle control member for limiting movement of said throttle control member, a manually actuatable adjustment member mounted on said cowl assembly for movement relative thereto, and means for moving said stop member in response to movement of said adjustment member, thereby adjusting the limit of movement of said throttle control member.

9. A marine propulsion device as set forth in claim 8 wherein said adjustment member is mounted for rotation relative to said cowl assembly and wherein said means for moving said stop member includes means for moving said stop member in response to rotation of said adjustment member.

10. A marine propulsion device as set forth in claim 9 wherein said stop member has a longitudinal axis and an end including said surface, wherein said stop member is mounted for movement along said longitudinal axis, and wherein said means for moving said stop member includes means for moving said stop member along said longitudinal axis in response to rotation of said adjustment member.

* * * * *